United States Patent [19]

Macken

[11] 4,195,729

[45] Apr. 1, 1980

[54] COMBINED PHOTOGRAPH HOLDER AND STORAGE DEVICE

[76] Inventor: John A. Macken, 4039 Shadow Hill Dr., Santa Rosa, Calif. 95404

[21] Appl. No.: 2,852

[22] Filed: Jan. 12, 1979

[51] Int. Cl.[2] ..... B65D 25/00; B65D 25/54

[52] U.S. Cl. ..... 206/45.34; 40/152

[58] Field of Search ..... 206/45.34; 40/152

[56] References Cited

U.S. PATENT DOCUMENTS

| | | | |
|---|---|---|---|
| 3,561,146 | 2/1971 | Dembar | 206/45.34 |
| 3,576,391 | 8/1971 | Knight, Jr. | 206/45.34 |
| 3,577,666 | 5/1971 | Wexler | 206/45.34 |
| 3,716,936 | 2/1973 | Miller | 40/152 |
| 3,737,093 | 6/1973 | Amberg et al. | 220/306 |
| 3,760,521 | 9/1973 | Barraya | 40/152 |
| 4,019,269 | 4/1977 | Vix | 40/152 |

*Primary Examiner*—William T. Dixson, Jr.
*Attorney, Agent, or Firm*—Edward E. Roberts

[57] ABSTRACT

A storage device is provided for storing elements such as tobacco or the like while providing a storage or display location for photographs or the like. The storage area is assembled within the display area which essentially surrounds the storage area. A decorative lid or top member is provided for closing the storage area and securing the display area. A suitable mounting base is also provided.

10 Claims, 2 Drawing Figures

COMBINED PHOTOGRAPH HOLDER AND STORAGE DEVICE

BACKGROUND

1. Field of the Invention

This invention is directed to decorative storage devices useful for displaying photographs or the like while storing condiments of a desirable nature.

2. Background

There are known in the art various storage devices or elements such as humidors, candy dishes or the like. In addition, there are known in the art many devices which are used for storage and display of photographs or other displayable objects and indicia. However, the known devices have never been combined nor is it apparent or obvious that the devices can be combined in any useful fashion.

SUMMARY OF THE INVENTION

The instant invention is directed to a combination storage device and display apparatus. The invention comprises a substantially clear or transparent box-like structure which is substantially cubic in configuration. The box includes four sides and one end member. A separate box-like structure of substantially similar configuration is provided to be inserted into the opeing in the clear or transparent box. The second mentioned box member may be transparent, transluscent or opague. A lid or top member is properly grooved and channeled to snugly mate with the inner box in order to provide a suitably tight fit. The outer surface of the lid or top may be appropriately treated or decorated. A bottom or support member is provided at the bottom of the outer box to support the device of the invention.

DESCRIPTION OF THE PREFERRED EMBODIMENT

Figure 1:
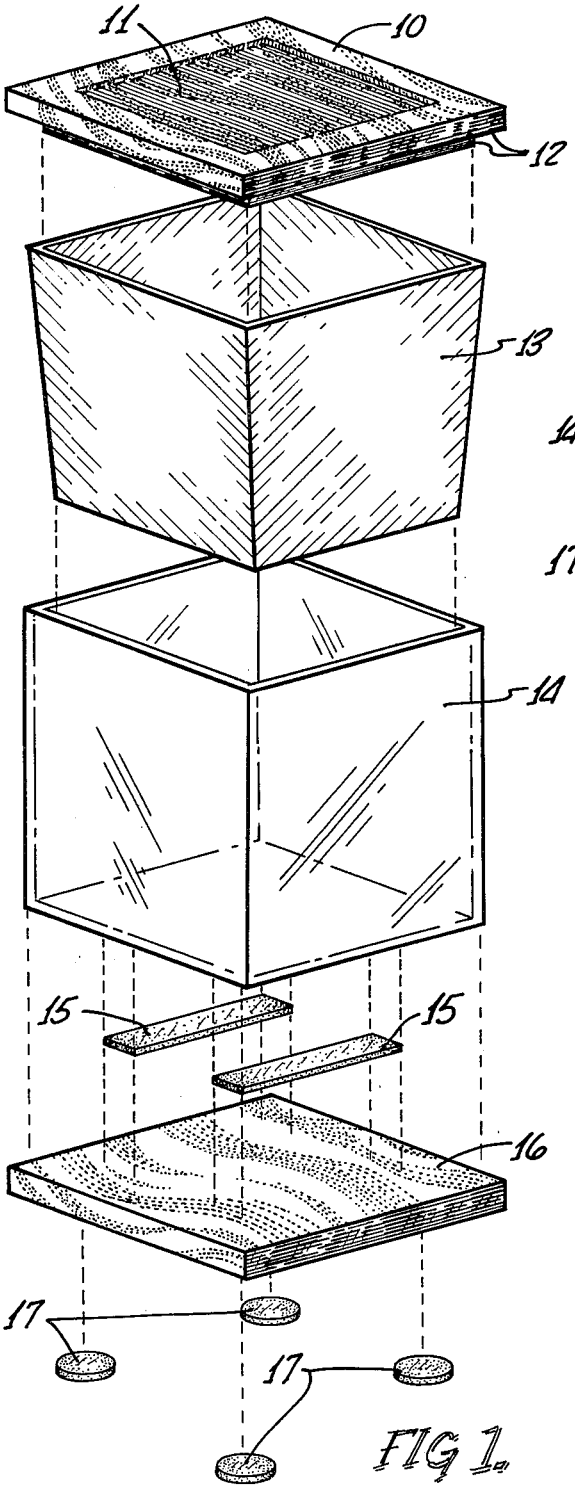
FIG. 1 is an exploded view of the device in the instant invention.

Referring now to FIG. 1, there is shown an exploded view of the device of the instant invention. The primary element comprises box 14. Box 14 is a five sided box-like structure which comprises four sides and a bottom. Box 14 may be fabricated of any suitable clear or transparent material. Typically, it is suggested that box 14 be fabricated of a clear acrylic plastic which is substantially transparent such that the materials therein can be viewed from the outside. In a preferred configuration, box 14 can be arranged so that respective sides are slightly larger at the top than at the bottom wherein box 14 is slightly tapered outwardly towards the open end thereof. This slight tapering permits easier removal of box 14 from the mold from which it is formed. Also, inserts can also be more easily removed. In one embodiment, the outer dimensions of box 14 are approximately 3 and 9/16 inches (outer dimensions) per side. The thickness of the respective walls of box 14 is a function of the strength of the materials to be utilized.

Inner box 13 is fabricated to be inserted into box 14. Typically, box 13 is also a five sided box having four sides and one end member. Box 13 can be formed of cardboard, plastic or any other suitable material. Typically, also, box 13 can be slightly tapered along the lines of box 14 in order to produce a snug fit between the two box-like structures.

Box 13 can be fabricated of a transparent, translucent or opaque material, as desired. However, the materials for box 13 will be somewhat determinative of the function and operation thereof. That is, different materials will probably be desirable for providing box 13 to store different materials therein. For example, tobacco, condiments or other items of this nature might require different materials for box 13 than a paper clip storage container or the like.

Base 16 is a generally square configured element which can be formed of wood, plastic or the like. Element 16 is provided as a support for the device of the instant invention. Element 16 can be fastened to box 14 in any suitable fashion. In a preferred embodiment, strips 15 of double-sided tape, glue or the like can be provided. While strips 15 are representative of two double-sided portions of tape, other arrangements can clearly be utilized if desired.

In addition, in a preferred embodiment, pads 17 which may be felt or rubber pads or feet can be applied to the underside of support element 16. These pads provide the usual function of supporting element 16 in a spaced-away relation to any support element such as a table surface or the like. Pads 17, thus, prevent any inadvertent scratching or marring of the surface.

A top or like 10 is provided for the invention. Top 10 may be approximately 4½ inches square (outer dimensions) in the preferred embodiment described herewith. A shoulder or shelf arrangement 12 is provided such that lid 10 first snugly into the opening in box 13. An area 11 of artwork or the like is also contemplated. Area 11 can be produced by laser engraving or other suitable process to establish a suitable design theme or the like in lid 10.

Figure 2:
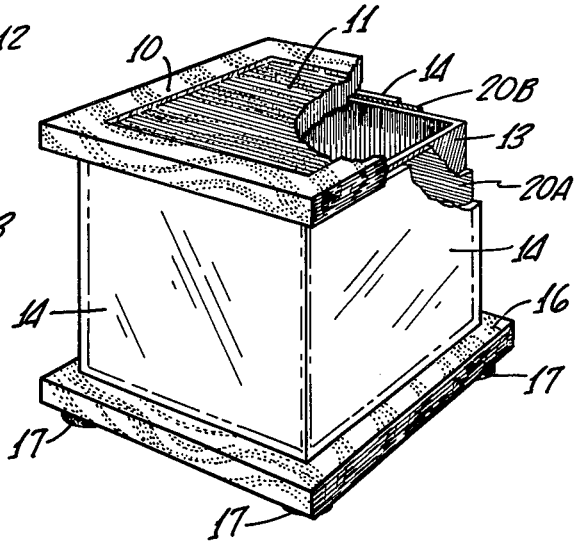
FIG. 2 is a partially broken away, perspective view of the invention after assembly.

Referring now to FIG. 2, there is shown a partially broken away perspective view of the instant invention. Similar elements bear similar reference numerals. Thus, it is seen that pads 17 are on the undersurface of support element 16 which is in contact with and supportive of box 14. Box 13 is inserted into box 14 and lid 10 is applied in an apparent fashion. Also shown in FIG. 2 are photographs 20A and 20B which are inserted between the sidewalls of boxes 13 and 14, respectively. Inasmuch as box 14 is formed of transparent material, the photographs or other suitable documents, displays, or the like 20A and 20B are visible from the exterior. In addition, the open portion of box 13 is available for storing of any suitable material.

Thus, there is shown and described a preferred embodiment of the instant invention. Illustrative materials and dimensions have been suggested. However, any suitable materials and dimensions can be utilized in effecting the teachings of this invention. Any teachings or modifications which fall within the purview of this description are intended to be included therein as well. The scope of the invention is limited only by the claims appended hereto.

Having thus described a preferred embodiment of the invention, what is claimed is:

1. A combined storage and display devise comprising:

a first box structure open at the top thereof and having four sides and a bottom formed of transparent materials;

a second box structure, open at the top thereof and having four sides and a bottom, inserted into said first box structure with a narrow space therebetween for placement between said first and second structure of photographs or the like to be viewed through said first box structure and lid means adapted to fit snugly in the open top of said second box and overlay the top of said first box to thereby close both of said first and second box structures.

2. The device recited in claim 1, wherein, at least said first box structure is slightly larger at the top thereof with said sides tapering from said bottom outwardly towards the open top thereof.

3. The device recited in claim 2, including, first support means for supporting said first box structure.

4. The device recited in claim 3 wherein, said lid means includes a decorative panel on the top thereof as a portion thereof.

5. The device recited in claim 4 wherein, said lid means further includes a shoulder or the like such that a first portion of said lid fits snugly into the open top of said second box and a second protion thereof overlays the top of both said first box and said second box.

6. The device recited in claim 5 including, second support means for supporting said first support means in a spaced-away relation to a table surface or the like.

7. The device recited in claim 5, including fastening means interposed between said first box structure and said support means.

8. The device structure recited in claim 7, wherein each of said first and second box structures are essentially cubic in configuration.

9. The device recited in claim 7 wherein, said first support means and said lid means are essentially of matching composition and configuration.

10. The device recited in claim 9, wherein said first box structure is formed of acrylic plastic.

* * * * *